United States Patent [19]

Kubach et al.

[11] Patent Number: 4,519,547

[45] Date of Patent: May 28, 1985

[54] INJECTION VALVE

[75] Inventors: Hans Kubach, Korntal-Münchingen; Wolfgang Kienzle; Werner Paschke, both of Schwieberdingen; Rudolf Sauer, Benningen, all of Fed. Rep. of Germany

[73] Assignee: Robert Bosch GmbH, Stuttgart, Fed. Rep. of Germany

[21] Appl. No.: 434,194

[22] Filed: Oct. 13, 1982

[30] Foreign Application Priority Data

Jul. 6, 1982 [DE] Fed. Rep. of Germany ..... 3225180

[51] Int. Cl.[3] ..... F02M 51/06

[52] U.S. Cl. ..... 239/585; 239/533.12

[58] Field of Search ..... 239/585, 533.3–533.12

[56] References Cited

U.S. PATENT DOCUMENTS

| | | | |
|---|---|---|---|
| 1,973,666 | 9/1934 | Sidney | 239/533.8 |
| 4,082,224 | 4/1978 | Mangus | 239/533.12 |
| 4,280,661 | 7/1981 | Tanasawa et al. | 239/585 X |
| 4,331,317 | 5/1982 | Kamai et al. | 239/585 |
| 4,423,841 | 1/1984 | Palma | 239/585 |

*Primary Examiner*—Andres Kashnikow
*Assistant Examiner*—James R. Moon, Jr.
*Attorney, Agent, or Firm*—Edwin E. Greigg

[57] ABSTRACT

An injection valve for fuel injection devices for internal combustion engines which serves to inject fuel into the intake pipe. The injection valve consists of a valve body with a valve seat cooperating with the sealing part of a valve needle. The valve needle is guided by guide sections in a guide bore of the valve body. The guide section immediately adjoining the sealing part simultaneously serves as a metering section for metering the fuel. For this purpose axially extending surfaces are disposed on the metering section, which form throttling metering openings together with the guide bore. By metering the fuel upstream from the valve seat, impairment of the fuel metering because of deposits formed by reaction of harmful materials from the intake pipe is avoided.

8 Claims, 5 Drawing Figures

INJECTION VALVE

BACKGROUND OF THE INVENTION

The invention is based on an injection valve for motor vehicles such as mixture-compressing spark-ignited internal combustion engines. In known injection valves, the fuel metering is performed downstream of the valve seat. Using such injection valves in motor vehicles, especially in those with exhaust gas recirculation, the water component of the exhaust gas condenses at the valve tip extending into the intake pipe and in the metering area of the injection valve. Sulfur oxides contained in the exhaust gas combine with the lead component of the fuel to form an insoluble layer diminishing the metering diameter of the injection valve, which causes a reduction of the amount of fuel injected, i.e., a so-called leaning of the fuel-air mixture. This can not only lead to interruptions in the running of the internal combustion engine but even to defects in the internal combustion engine.

OBJECT AND SUMMARY OF THE INVENTION

In contrast to the foregoing, the injection valve in accordance with the present invention has the advantage that the harmful gases are kept away from the fuel metering position of the injection valve, so that metering mistakes are prevented by avoidance of the forming of layers on the fuel metering device.

The invention will be better understood and further objects and advantages thereof will become more apparent from the ensuing detailed description of preferred embodiments taken in conjunction with the drawings.

BRIEF DESCRIPTION OF THE DRAWINGS

In the drawings, four exemplary embodiments of the present invention are shown in simplified form and are further explained in the following description.

DESCRIPTION OF THE PREFERRED EMBODIMENTS

Figure 1:
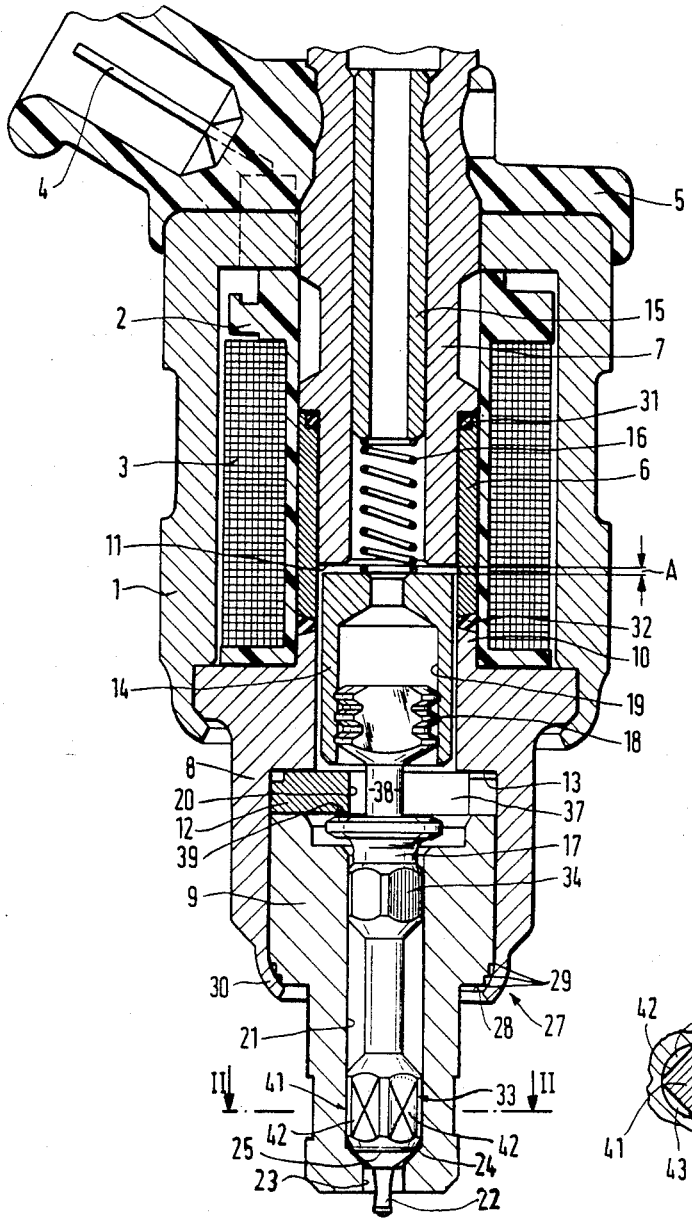
FIG. 1 shows a first exemplary embodiment of an injection valve.

The fuel injection valve for a fuel injection apparatus of a mixture-compressing spark-ignited internal combustion engine shown as an example in FIG. 1 has a valve housing 1 in which a magnetic coil 3 is disposed on a coil support 2. The magnetic coil 3 is supplied with current via a plug connection 4 embedded in a plastic ring 5, which partially surrounds the valve housing 1.

A non-magnetic sleeve 6 is disposed in the magnetic coil 3, which is tightly welded or brazed on one side to a connecting pipe 7, which is connected to the fuel feed line, and on the other side to a connector housing 8 for a valve body 9. The connector housing 8 has a cylindrical connector 10 corresponding in its inner and outer diameters with the non-magnetic sleeve 6, so that the connection between the two parts is without interruption and in alignment.

The armature 14 of the fuel injection valve is within the sleeve 6, and located between an end face 11 of the connecting pipe 7, and a stop plate 12. The stop plate 12 has a predetermined thickness for the purpose of exact adjustment of the valve, and is disposed on an inner shoulder 13 of the connector housing 8. The armature 14 comprises of a magnetic material which is not subject to corrosion. A pressure spring 16 is disposed between the armature 14 and a pipe insert 15 fastened within the connecting pipe by tapering the pipe. A valve needle 17 is fastened in a bore 19 in the lower end of the armature 14 by forcing the annular ribbed end 18 into the bore 19.

The valve needle 17 extends with radial play through a passage 20 in the stop plate 12 and through a guide bore 21 in the valve body 9. The valve needle includes a needle tang 22 on its lower end which protrudes from an injection port 23 of the valve body 9. A conical valve seat surface 24 is formed between the guide bore 21 of the valve body 9 and the injection port 23, which acts together with a sealing part 25, formed by two conical surfaces of differing inclination on the valve needle 17. The length of the valve needle 17 in combination with the armature 14 is calculated in such a way, that starting from the sealing part 25, the armature 14 leaves a work gap opening A opposite the end face 11 of the connecting pipe 7 during the non-excited state of the magnetic coil 3 and at such time that the valve is closed.

A sealing point 27 of the injection valve is formed on the outer shoulder 28 of the valve body by having at least one—in the example, three—annular sealing edge on the valve body formed by folding the sealing edge of the connector housing 8 against the valve body by any suitable means such as by use of a crimping or roller-burnishing tool. The hardened sealing edges 29 dig ito the softer inner wall of the connector housing 8, thus making a dependable metallic seal.

Two additional sealing points 31 and 32 of the fuel injection valve are provided on the non-magnetic sleeve 6. These sealing points are metallic and therefore dependable and not subject to wear. The sealing points 31 and 32 are formed either by welding or brazing or they are formed of soft iron or copper rings.

The valve needle 17 has two guide sections 33 and 34 guiding the valve needle 17 in the guide bore 21. They leave open axially aligned passages for the fuel and are formed as square bars, for instance.

Between the passage 20 and the inner circumference of the stop plate 12, a recess 37 is provided, the inner diameter of the recess is larger than the diameter of the valve needle in the corresponding portion 38 of the valve needle 17 between the annular ribbed end 18 and the stop shoulder 39 of the valve needle 17. If the magnetic coil 3 is excited, the armature 14 is moved in the direction of the opening of the fuel inlet in the valve needle 17 against the force of the pressure spring 16 and touches the stop shoulder 39 of the stop plate 12.

In accordance with the present invention, the guide sector 33 of the valve needle 17, which lies upstream immediately adjacent to the sealing part 25 simultaneously serves as a metering section 41. For this purpose, metering grooves 43 (FIG. 2) are formed between the surfaces 42, extending axially and parallel to the axis of the valve needle 17 at the metering section 41, and the guide bore 21. The guide bore includes throttle points which provide considerable resistance to fuel flow and together with the timed length of the electrical opening impulses lifting the valve needle 17 from its valve seat 24 determines the amount of fuel per time unit injected into the intake pipe of the internal combustion engine.

Figure 2:
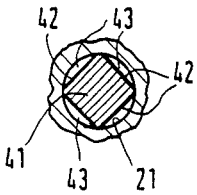
FIG. 2 shows a section along the line II—II of FIG. 1.
Figure 3:
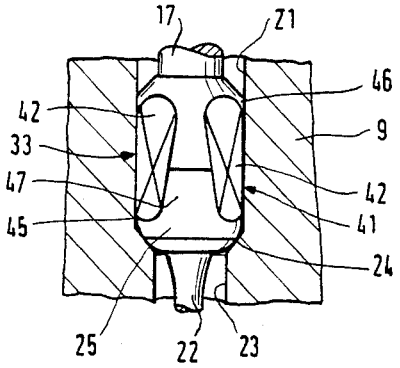
FIG. 3 shows a partial view of a second exemplary embodiment of an injection valve.
Figure 4:
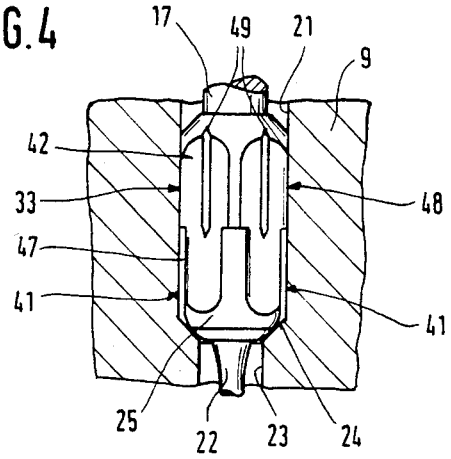
FIG. 4 shows a partial view of a third exemplary embodiment of an injection valve.

The flat surfaces 42 of the metering section 41 extend in a plane parallel to the axis of the valve needle 17 in the first exemplary embodiment of the present invention according to FIGS. 1 and 2. In the second exemplary embodiment in accordance with FIG. 3, the surfaces 42 are inclined in respect to the axis of the valve needle 17 in such a way that the distance between the axis of the valve needle 17 and the plane extending through the corresponding surface 42 is smaller at the end 45 facing towards the sealing part 25 than at the end 46 facing away from the sealing part. As in the foregoing exemplary embodiment, either four or more or less surfaces 42 can be formed on the metering section 41. Across the length of the supply section 42, additional supply grooves 49 which open toward the surfaces 42 are embedded into the surfaces 42, making possible a larger flow-through section in this area. For the purposes of calibrating the fuel injection amount statically, the supply section 42 can be given a smaller diameter by needle lapping than the guide section 33; in this way the metering section 41 simultaneously serves as adjusting section 47.

Figure 5:
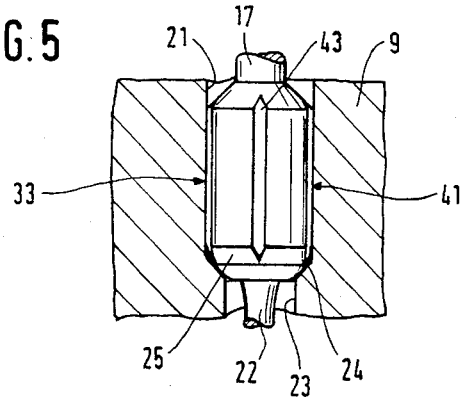
FIG. 5 shows a partial view of a fourth exemplary embodiment of an injection valve.

In accordance with the fourth exemplary embodiment of the present invention in FIG. 5, metering grooves 43, open towards the circumference of the metering section 41, are formed as longitudinal slits; preferably three or more longitudinal slits are provided formed, for example, by eroding. By reworking, for instance, only one metering groove 43, the static fuel injection amount can be adjusted very exactly. The metering grooves 43 can also be formed in the form of knurling onto the metering section 41.

It is also possible to combine the embodiments in accordance with FIGS. 1 to 5, i.e., to provide for the metering longitudinal slits 43 beside the surfaces 42, which can be placed in the surfaces 42 or at another place on the circumference of the metering section 41.

The exemplary embodiments in accordance with the present invention described above have the advantage of providing for the fuel metering upstream of the valve seat 24. This way harmful gases emanating from the intake pipe are kept away from the fuel metering position while the injection valve is closed. In order to obtain a dead volume as small as possible, the fuel metering position should be placed upstream of the valve seal 24 and as close to it as possible.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An injection valve for fuel injection devices for mixture-compressing internal combustion engines with externally supplied ignition comprising a valve body, a valve needle guide bore in said valve body, a valve seat in said valve body, an electromagnetically actuated valve needle, said valve needle including a sealing part cooperating with said valve seat and first and second guide sections on said valve needle upstream of said valve seat for guiding the valve needle in said guide bore, characterized in that said first guide section of the valve needle is disposed immediately upstream of and adjacent the sealing part, a metering section formed on said first guide section which serves to meter the quantity of fuel delivered by said injection valve, and an axially aligned injection port surrounding an end portion of said valve needle.

2. An injection valve in accordance with claim 1, characterized in that the metering section extends to the sealing part.

3. An injection valve in accordance with claim 2, characterized in that the metering section is provided with axially extending flat surfaces on the circumference of said first guide section.

4. An injection valve in accordance with claim 3, characterized in that said flat surfaces are inclined with respect to the axis of the valve needle in such a way that the distance between the axis of the valve needle and each flat surface is smaller at its end facing away from said sealing part.

5. An injection valve in accordance with claim 3, characterized in that said first guide section has a supply section facing away from said sealing part and a metering section facing said sealing part and further includes supply grooves in the surfaces which open towards the flat surfaces and extend over the supply section and the metering section of said guide section.

6. An injection valve as set forth in claim 3, characterized in that there are four flat surfaces on the said guide section and the metering section.

7. An injection valve in accordance with claim 2, characterized in that said metering section has axially extending metering grooves which open towards said guide bore.

8. An injection valve in accordance with claim 7, characterized in that an adjustment section is provided at the metering section, said adjustment section having a smaller diameter, proportional to the metered amount of fuel, than said first guide section.

* * * * *